US009718646B2

(12) United States Patent
Srb-Gaffron et al.

(10) Patent No.: US 9,718,646 B2
(45) Date of Patent: Aug. 1, 2017

(54) CHAIN DRIVE SYSTEM WITH POLYGON COMPENSATION

(71) Applicant: Otis Elevator Company, Farmington, CT (US)

(72) Inventors: Walter Srb-Gaffron, Baden (AT); Martin Michalke, Brunn am Gebirge (AT); Phillip Schedl, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 14/782,850

(22) PCT Filed: Apr. 8, 2013

(86) PCT No.: PCT/IB2013/052798
§ 371 (c)(1),
(2) Date: Oct. 7, 2015

(87) PCT Pub. No.: WO2014/167379
PCT Pub. Date: Oct. 16, 2014

(65) Prior Publication Data

US 2016/0039641 A1 Feb. 11, 2016

(51) Int. Cl.
*B66B 23/02* (2006.01)

(52) U.S. Cl.
CPC ..... *B66B 23/022* (2013.01)

(58) Field of Classification Search
CPC ..... B66B 23/02; B66B 23/022
USPC ..... 198/330
See application file for complete search history.

(56) References Cited

U.S. PATENT DOCUMENTS

| | | | | |
|---|---|---|---|---|
| 3,314,526 | A | 4/1967 | Tadeusz et al. | |
| 3,677,388 | A | 7/1972 | Boltrek et al. | |
| 4,498,890 | A * | 2/1985 | Sutherland | B66B 23/022 474/140 |
| 4,671,783 | A | 6/1987 | Seymour | |
| 5,306,212 | A | 4/1994 | Eberle | |
| 6,540,060 | B1 * | 4/2003 | Fargo | B66B 23/02 198/326 |
| 6,685,003 | B2 | 2/2004 | Copeland et al. | |
| 2002/0053499 | A1 | 5/2002 | Zurcher | |
| 2004/0168891 | A1 | 9/2004 | Pietz | |

(Continued)

FOREIGN PATENT DOCUMENTS

| | | | |
|---|---|---|---|
| DE | 19849236 | A1 | 2/2000 |
| WO | 03066501 | A1 | 8/2003 |
| WO | 2012161691 | A1 | 11/2012 |

OTHER PUBLICATIONS

International Search Report for application PCT/IB2013/052798, dated Jan. 21, 2014, 4 pages.

(Continued)

*Primary Examiner* — James R Bidwell
(74) *Attorney, Agent, or Firm* — Cantor Colburn LLP

(57) ABSTRACT

A chain drive includes a chain configured to rotate in a closed loop forming a load track and a return track interconnected by first and second turnaround sections; a drive sprocket for driving the chain, the drive sprocket being located in the first turnaround section of the closed loop; and a polygon compensation system for compensating the polygon effect of the chain. At least one component of the polygon compensation system is located within at least one turnaround section.

19 Claims, 10 Drawing Sheets

(56) References Cited

U.S. PATENT DOCUMENTS

| | | | | |
|---|---|---|---|---|
| 2005/0016817 | A1* | 1/2005 | Pietz | B66B 25/00 198/330 |
| 2005/0061608 | A1* | 3/2005 | Pietz | B66B 23/022 198/330 |
| 2005/0061609 | A1* | 3/2005 | Pietz | B66B 25/00 198/330 |
| 2006/0108196 | A1* | 5/2006 | Ishikawa | B66B 23/022 198/321 |
| 2009/0065328 | A1 | 3/2009 | Gonzalez Alemany et al. | |
| 2012/0181143 | A1* | 7/2012 | Lanzki | B66B 23/028 198/330 |

OTHER PUBLICATIONS

Third Party Submission for European Patent Application EP 13881783.8, dated Oct. 19, 2016, 19 pages.

* cited by examiner

CHAIN DRIVE SYSTEM WITH POLYGON COMPENSATION

FIELD OF THE DISCLOSURE

The present disclosure generally relates to chain and sprocket driven systems and, more particularly, relates to suppressing a polygon effect associated with chain and sprocket driven systems, such as, passenger conveyor systems.

BACKGROUND OF THE DISCLOSURE

Several types of passenger conveyor systems, such as, escalators, moving walkways, moving sidewalks, etc. are widely used these days to effectively transport pedestrian traffic or other objects from one location to another. Areas of usage of these passenger conveyor systems often include airports, hotels, shopping malls, museums, railway stations and other public buildings. Such passenger conveyor systems typically have two landings (e.g., a top landing and a bottom landing in case of an escalator) and a a plurality of steps/treads traveling in a closed loop in between the landings. The closed loop forms a load track and a return track interconnected by first and second turnaround sections located at the landings. Passenger conveyors may also include moving handrails traveling together with the steps/treads and a truss structure supporting the treads/steps and moving handrails. The steps/treads may be driven by a step chain (also called an escalator chain) in a closed loop to transport the pedestrian traffic between the two landings. Typically, the step chain is driven by a step chain sprocket and travels in a closed loop forming a load track and a return track interconnected by first and second turnaround sections. In particular configurations of a passenger conveyor system a drive module having a motor and a main shaft drives one or more main drive chain sprockets. The main drive chain sprockets drive the step chain sprocket which is engaged by the step chain. The step chain engages the treads/steps for moving the treads/steps around their closed loop.

The interaction of the step chain with the step chain sprocket often produces fluctuations and vibrations. By way of background, a step chain, like any other chain drive, includes a plurality of discrete chain links, called step chain links, connected together by way of connecting links, such as a pin and a link plate or a roller. A drive sprocket (e.g., the step chain sprocket) includes a profiled wheel having a plurality of engaging teeth for meshing and engaging the connecting links (or possibly even engaging the step chain links) of the step chain, in order to move the step chain as the step chain sprocket rotates. The engagement of the connecting links of the step chain with the engaging teeth of the step chain sprocket causes the step chain to vibrate and fluctuate. These vibrations and fluctuations are often called a polygon effect or a chordal action and not only affect the ride experience of a user (who typically feels these vibrations and fluctuations aboard the passenger conveyor system), but also cause undesirable friction between the step chain and the step chain sprocket, thereby reducing the service life time of those components. Noise generated by the vibrations resulting from the engagement of the step chain with the step chain sprocket is another concern.

Therefore, mitigating or compensating the polygon effect is desirable. Several solutions to reduce or otherwise mitigate the polygon effect have been proposed in the past. Generally, the intensity of polygon effect depends on the velocity of the step chain and the length of the chain links in relation to the diameter of the sprocket. The greater said relation, i.e. the larger the length of the chain links and/or the smaller the diameter of the sprocket, and the higher the velocity of the step chain, the stronger the polygon effect. One possibility for reducing the polygon effect thus is to reduce the pitch of the step chain. In consequence, one approach of mitigating the polygon effect involves increasing the number of step chain links in the step chain (which can reduce the step chain pitch), and/or correspondingly increasing the diameter of the step chain sprocket(s) to increase the number of teeth in engagement with the sprocket (which may also effectively reduce the step chain pitch). This techniques, although effective in improving the riding experience of a user, nonetheless have several disadvantages.

For example, due to the increase in the number of the parts (e.g., increase in the number of step chain links and other associated parts, such as rollers, pins, bushings, link plates, etc., of the step chain, and/or a bigger sprocket), the overall cost of the associated system increases.

Furthermore, the efforts involved with the necessary maintenance of the increased number of components increases, and so does the amount of lubricant needed to reduce the increased wear and tear amongst those components. This increased wear and tear can additionally reduce the service life time of the step chain and the step chain sprocket. Moreover, the aforementioned approach does not address to the noise issue discussed above, and may in fact increase the noise due to a greater engagement of the step chain with the step chain sprocket.

WO 2012/161691 A1 discloses a polygon compensation coupling system for reducing a polygon effect in a chain driven system, the polygon compensation coupling system including a chain sprocket and a main drive in engagement with the chain sprocket, such that the engagement defines a compensation curve to reduce the polygon effect.

U.S. Pat. No. 6,351,096 B1 and WO 01/42122 A1 disclose an electronic drive system, which is configured to control a motor driving the sprocket of a chain drive so that it rotates with non constant velocity, the non-constant rotation of the sprocket compensating the polygon effect.

WO 03/066501 A1 describes to a pulse free escalator system having two spaced apart pulse free turnaround sections. The escalator system has a pair of guide tracks and a pair of linkage assemblies, each comprising a plurality of links joined together. Each linkage assembly has a plurality of rollers for supporting the linkage assembly which travel in a respective one of the guide tracks. Each guide track has two spaced apart turnaround portions with each turnaround portion defining a travel path for each roller having first and second constant radius sections adjacent to a linear entry section and a linear exit section, respectively, and a pulse-free section intermediate said first and second constant radius sections.

EP 1 479 640 B1 and U.S. Pat. No. 4,498,890 teach to compensate the polygon effect by providing a curved track section having a varying curvature in the linear portion of the chain next to the sprocket. Such curved track sections, however, reduce the usable length of the chain loop, as the portion of the loop in which the curved section is located may not be used for transportation.

Accordingly, there is a need for a more effective solution to compensate the polygon effect in chain drives. It would be particularly beneficial if such solution provided a convenient tool to provide sufficient polygon compensation for chain drives of any geometry.

In addition it would be particularly beneficial to have available a polygon compensation technique that improves the riding experience of the users without incurring any additional costs associated with increasing the step chain links or with using a larger diameter step chain sprocket. It would further be beneficial if such a technique were reliable, easy to maintain, increased (or at least did not negatively impact) the service life time of the step chain and the step chain sprocket (e.g., by reducing wear and tear), and additionally provided a greener approach (by using less lubricant) to solving the polygon effect problem. It would additionally be desirable if this technique reduced the noise generated by the step chain and the step chain sprocket engagement and would not reduce the usable length of the chain.

Although the embodiments described herein focus towards a step chain driven passenger conveyor system, it be understood that similar problems with respect to occurrence of a polygon effect apply to other chain driven systems as well, and therefore the solutions suggested below may be beneficial to other types of chain driven systems, in particular to other types of chain driven conveyor systems.

SUMMARY OF THE DISCLOSURE

In accordance with an exemplary embodiment of the present disclosure, a chain drive is disclosed which comprises: a chain configured to rotate in a closed loop forming a load track and a return track interconnected by first and second turnaround sections; a drive for driving the chain; and a polygon compensation system for compensating the polygon effect of the chain. At least one component of the polygon compensation system is located in at least one of the turnaround sections and/or in at least one of the load track and the return track of the closed loop.

In accordance with another exemplary embodiment of the present disclosure, a method of designing a polygon compensation system for compensating the polygon effect in an endless chain drive including a chain configured to rotate in a closed loop forming a load track and a return track interconnected by first and second turnaround sections; is disclosed. Such method comprises: Designing at least one component of the polygon compensation system located in at least one straight section of the closed loop, and subjecting said least one component located in said straight section to a transformation, such as to move said at least one component located in said straight section along the closed loop to form a component located at least partly in a curved section of the closed loop and/or to split said at least one component located in a straight section into at least two components arranged within the closed loop.

In accordance with another exemplary embodiment of the present disclosure a method of operating a conveyor system including a step chain rotating in a closed loop comprising a load track and a return track interconnected by first and second turnaround sections; a drive for driving the step chain; and a polygon compensation system for compensating the polygon effect of the step chain, wherein at least one component of the polygon compensation system is provided in at least on of the turnaround sections and/or in at least one of the load track and the return track of the closed loop, comprises the step of rotating the drive sprocket with constant velocity.

In accordance with a further exemplary embodiment of the present disclosure a method of operating a conveyor system including a step chain rotating in a closed loop comprising a load track and a return track interconnected by first and second turnaround sections; a drive for driving the step chain; and a polygon compensation system for compensating the polygon effect of the step chain, wherein at least one component the polygon compensation system is provided in at least one of the turnaround sections and/or in at least one of the load track and the return track of the closed loop, comprises the step of rotating the drive sprocket with non-constant velocity in order to compensate the polygon effect.

Advantages and features of exemplary embodiments of the invention will be apparent from the following detailed description when read in conjunction with the attached drawings.

While the following detailed description has been given and will be provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims eventually appended hereto.

DETAILED DESCRIPTION

Figure 1:
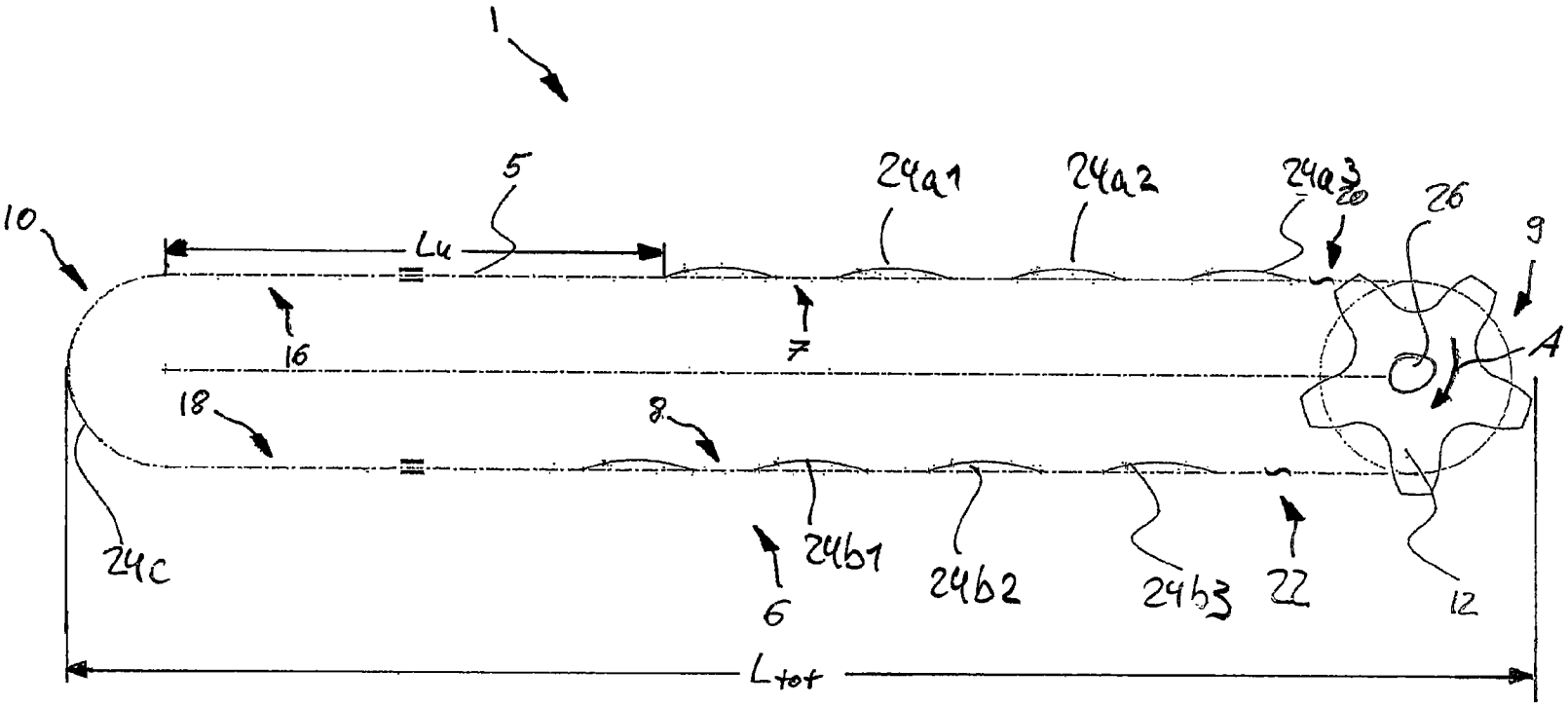
FIG. 1 shows a schematic view of a chain drive according to an embodiment of the invention.

FIG. 1 shows a schematic view of a chain drive 1 according to an embodiment of the invention. The chain drive comprises a chain 5 configured to rotate in a closed loop 6 forming a load track 7 and a return track 8 interconnected by first and second turnaround sections 9, 10 located at the lateral ends of the loop 6. A drive sprocket 12 configured for driving the chain 5 is arranged in the first turnaround section 9 shown on the right side of FIG. 1.

In the exemplary embodiment shown in FIG. 1 the drive sprocket 12 will turn clockwise in normal operation, as indicated by arrow A. In consequence, in normal operation the chain 5 will travel from left to right in the upper load track 7 and from right to left in the lower return track 8.

In the second turnaround section 10 the chain 5 is guided by a stationary turnaround structure, such as to reverse direction of travel by 180 degrees before entering the load section. The second turnaround section 10, opposite to first turnaround section 9 and shown on the left side of FIG. 1, is not formed strictly semicircular, but extends at least partially along a polygon compensation curve 24*c*, which is designed for compensating the polygon effect of the chain 5 traveling along the loop 6. I.e. the arc of second turnaround section 10 is formed so that the chain 5 entering the second turnaround section 10, which is coming from the lower return track 8 with constant velocity, will leave the second turnaround section 10 propagating into to upper load track 7 with constant velocity, as well. A more detailed description for designing polygon compensation curves 24 is given below.

Thus, the second turnaround section 10 compensates for the polygon effect which normally would be generated by turning the chain 5 by 180° in the second turnaround section 10.

In order to compensate for the polygon effect caused by turning the chain 5 by 180 degrees in the first turnaround section 9, curved portions 24*a*, 24*b* may be arranged next to the drive sprocket 12 in the load track 7 and/or in the return track 8 of the closed loop 6, respectively. In consequence, the chain 5 will travel along the closed loop 6 with non-constant velocity, as indicated by ("~"), in sections 20 and 22 located between the curved portions 24*a*, 24*c* via the drive sprocket 12, and with constant velocity, as indicated by ("="), in sections 16 and 18 next to the second turnaround section 10. Section 16 is part of the upper load section 7 and may be used for the desired transportation. Thus, the usable length $L_u$ of section 16 is the portion of the length $L_{tot}$, of the closed loop 6 which may be used for transportation.

In principle, a single curved compensation portion 24*a*, 24*b* could be used in the load track 7 and in the return track 8, respectively. However, in case more than one curved compensation portion 24*a*1, 24*a*2, 24*a*3; 24*b*1, 24*b*2, 24*b*3 is used in each of the tracks 7, 8, as it is shown in FIG. 1, the maximum height (amplitude) of each of the curved portions 24*a*1, 24*a*2, 24*a*3; 24*b*1, 24*b*2, 24*b*3 may be set lower compared to a case in which only a single curved compensation portion 24*a*, 24*b* is employed. Reducing the amplitude of the curved compensation portions 24*a*1, 24*a*2, 24*a*3; 24*b*1, 24*b*2, 24*b*3 reduces the deflecting angle of the chain links 5*b* when traveling along the curved compensation portions 24*a*1, 24*a*2, 24*a*3; 24*b*1, 24*b*2, 24*b*3, as well as the force acting on the joints or rollers 5*c* of the chain 5 when passing through the curved compensation portions 24*a*1, 24*a*2, 24*a*3; 24*b*1, 24*b*2, 24*b*3. In consequence, the additional load acting on the chain 5, which is caused by the curved compensation portions 24*a*1, 24*a*2, 24*a*3; 24*b*1, 24*b*2, 24*b*3, is reduced, when a plurality of curved compensation portions 24*a*1, 24*a*2, 24*a*3; 24*b*1, 24*b*2, 24*b*3 is provided in each of the tracks 7, 8. A method for designing split curved compenstation portions 24*a*1, 24*a*2, 24*a*3; 24*b*1, 24*b*2, 24*b*3 will be explained in more detail below.

In order to increase the usable length $L_u$ of the chain drive 1, the curved compensation portions 24*a* provided in the load track 7 for compensating the polygon effect generated by the chain 5 entering the drive sprocket 12 may be replaced or supplemented by a polygon compensation coupling (PCC) system causing the drive sprocket 12 to rotate with non-constant velocity in order to compensate for the polygon effect. An example of such polygon compensation coupling system is described in WO 2012/161691 A1.

While the load track 7 and the return track 8 have been shown as linear sections of the closed loop, it be understood that such load track 7 and/or such return track 8 may include one, or a plurality of, curved or bent section(s), i.e. section extending with a curvature. Curved sections of the load track 7 and/or return track 8 may e.g. be formed in the transition regions of an inclined conveyor like an escalator, where the load track 7 and/or return track 8 changes from an inclined orientation towards a horizontal orientation at the lower and upper landings. Curved compensation portions for compensating a polygon effect may be arranged anywhere in the load track 7 and/or in the return track 8, including curved or bent portions of the load track 7 and/or return track 8 as described above.

A method for determining an analytic formula for a compensation curve 24*a* located in a linear portion of the track will be described with reference to FIG. 2*a*, which demonstrates the principal denominations and geometrical relationships in a turnaround section 9. In the schematic representation of FIG. 2*a* the drive sprocket 12 is illustrated on the left side, but it will be understood that the same considerations will apply to a drive sprocket or idler sprocket on the right side (as shown in FIG. 1). It is assumed that the sprocket 12 of FIG. 2*a* rotates in counterclockwise direction and therefore the chain 5 travels in counterclockwise direction approaching the sprocket 12 on the left side of FIG. 2*a* on the top side and leaving the sprocket 12 on the bottom side.

Figure 2A:
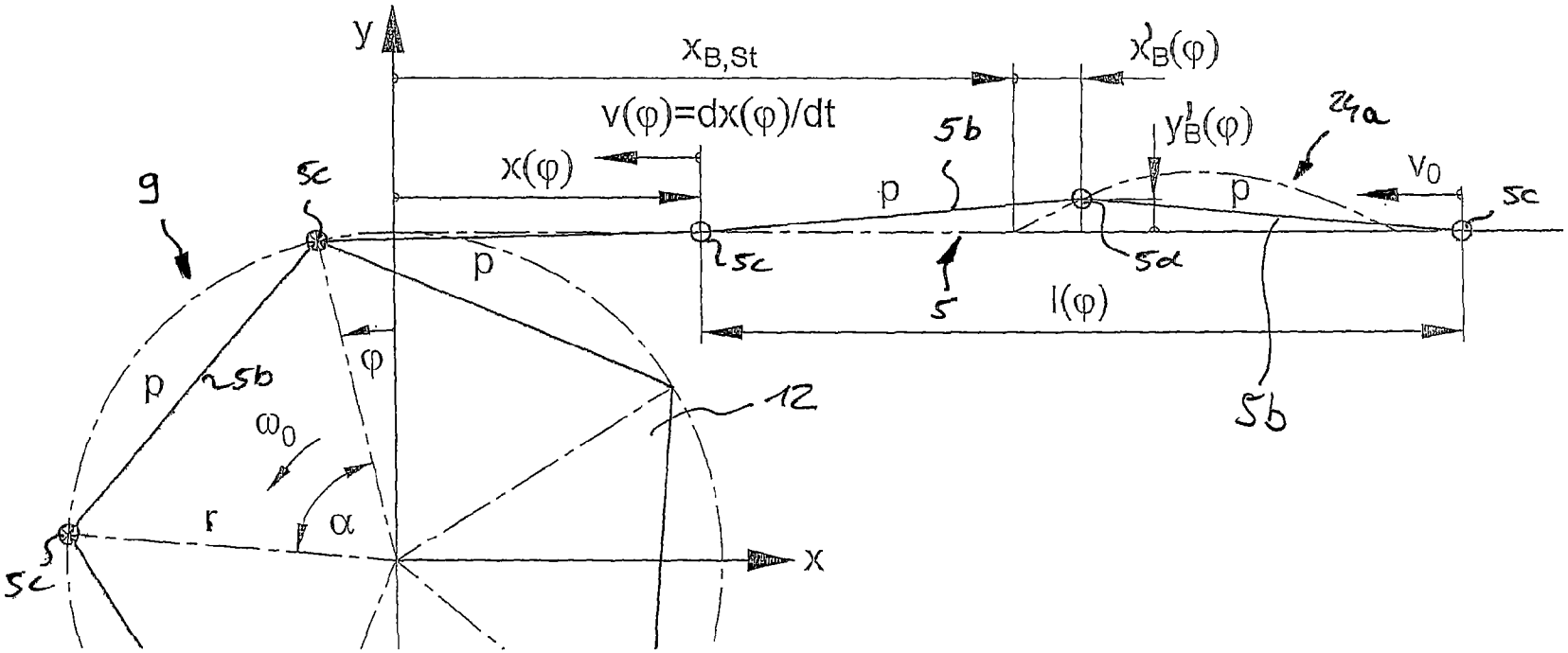
FIG. 2*a* illustrates a method of determining the compensation curve in a linear portion of the chain track upstream of a sprocket rotating with constant angular velocity.

The symbols used in FIG. 2*a* have the following meaning:

p chain pitch r pitch circle of the sprocket 12 (i.e. circle where the rollers of the chain engage the sprocket)

$\omega_0$ constant angular velocity of the sprocket 12 v linear velocity of the chain 5 (in non-compensated situation, chain velocity v therefore is not constant)

$v_0$ linear, constant velocity of the chain 5 after compensation

ω angular position of the first sprocket tooth engaged by a roller 5*c* of the chain 5 l(ω) projected length (projected in travel direction of the chain) of the chain link pair 5*b*, 5*b* deflected because the corresponding common chain roller 5*d* travels along the compensation curve, the deflection of the chain link pair 5*b*, 5*b* results in a velocity difference or correction velocity $\Delta v = v(\phi) - v_0$ n number of teeth of the sprocket 12

α pitch angle of the sprocket (pitch angle is obtained by dividing a full circle by the number of teeth n)

$x'_B(\phi)$, $y'_B(\phi)$ coordinates of the compensation curve 24*a* in linear chain section, measured from the end point of compensation curve 24*a* oriented towards the sprocket 12

According to FIG. 2*a*, the compensation of the polygon effect is realized by a compensation curve 24*a* located in the linear area of the step chain track where the step chain approaches the sprocket 12, e.g. in the load track and/or in the return track. Every chain link 5*b* has to move along this compensation curve 24*a*. The compensation curve 24*a* shall be designed in such a manner that the links 5*b* of the chain 5, before entry into the compensation curve 24*a* (i.e on the right side of the compensation curve 24*a* in FIG. 2*a*), travel with constant (horizontal) velocity $v_0$. After leaving the compensation curve 24*a*, but before engaging with the sprocket 12 (i.e. in the section left of the compensation curve 24*a*, but right of sprocket 12 in FIG. 2*a*) or entering a turnaround section 9, 10, the links travel with a predetermined, non-constant velocity v. The non-constant velocity v is determined corresponding to the kinematics of engagement of the chain rollers 5*c* with the sprocket 12, such as to compensate for the polygon effect.

For easier understanding, only a sprocket 12 and its geometry will be discussed in detail in the following. However, it be understood that the same considerations apply in case of a chain track following otherwise bent curves. E.g. in case of a return section or transition section bent along a non circular path, the compensation curve would look somewhat different due to a different behavior of the angular velocity, but the principal considerations determining the geometry of the compensation curve remain the same. In case of a return section following a half-circular path or a transition section following a part circular path, the same considerations as set out for a sprocket apply.

As derivable from FIG. 2*a*, the position of the joint 5*c* closest to the sprocket 12, but not yet engaging the sprocket, can be determined by the following equation:

$$x(\varphi) = r\left[\sqrt{\left(\frac{p}{r}\right)^2 - (1-\cos\varphi)^2} - \sin\varphi\right]$$

The uncompensated velocity in x-direction v(ϕ) of the joint 5*c* closest to the sprocket 12 can be expressed by the following equation:

$$v(\varphi) = -r\omega_0\left[\frac{(1-\cos\varphi)\sin\varphi}{\sqrt{\left(\frac{p}{r}\right)^2 - (1-\cos\varphi)^2}} + \cos\varphi\right]$$

The uncompensated acceleration in x direction dv/dt of the joint 5*c* closest to the sprocket 12 can be expressed by the following equation:

$$\frac{dv(\varphi)}{dt} = -r\omega_c^2\left\{(1-\cos\varphi)\left[\frac{1+2\cos\varphi}{\sqrt{\left(\frac{p}{r}\right)^2 - (1-\cos\varphi)^2}} + \frac{(1-\cos\varphi)\sin\varphi^2}{\sqrt{\left[\left(\frac{p}{r}\right)^2 - (1-\cos\varphi)^2\right]^3}}\right] - \sin\varphi\right\}$$

The acceleration $dv/dt=d^2x/dt^2$ of a joint 5*c* of the chain, which results from the kinematic relations in the sprocket 12, shall be eliminated by deflecting one chain joint (roller) 5*d* outside the linear track (i.e. in y direction) along an exactly defined compensation curve 24*a*. When the joint 5*d* is traveling along the compensation curve 24*a*, two adjacent chain links 5*b*, 5*b* will be deflected, which causes a time dependent length change of the projected length l(ϕ) and a relative movement between the respective adjacent joints 5*c*, 5*d*, 5*c*, as indicated in FIG. 2*a*. The projection in the direction of the track (to simplify the explanation, in the following the track shall be considered to be horizontally arranged and thus this projection will be referred as horizontal projection) of this relative movement of the deflected chain links 5*b*, 5*b* results in a periodical change of the horizontal distance between the joint 5*d* traveling along the compensation curve 24*a* and the adjacent joints 5*c*, 5*c* traveling on the linear track sections adjacent the compensation curve 24*a*. In the horizontal projection, the joints 5*c*, 5*d* can move towards, or apart from, each other. The polygon effect, which results from the engagement of the chain joints 5*c* with the sprocket 12, can be compensated ("depolygonized") by fulfilling the condition that the rate of the time dependent length change l(ϕ), referred to as dl/dt, always compensates the velocity difference Δv(ϕ) between the kinematically forced actual velocity v(ϕ) and the intended constant velocity $v_0$ of the chain ($\Delta v(\phi)=v(\phi)-v_0$), i.e. $dl/dt=-\Delta v(\phi)$.

Due to the pitch p of the chain 5, the polygon effect is of a periodical nature. The velocity fluctuation caused by the polygon effect is reiterating for each consecutive tooth of the sprocket 12 engaging with the consecutive joint 5*c* of the chain 5. Such fluctuation has a periodicity which may be expressed in terms of time ΔT, in terms of pitch angle α, or in terms of pitch p, respectively. Because of such periodicity, the horizontal extent of the compensation curve 24*a* cannot be larger than the chain pitch length p and, for any given moment of time, only a single joint 5*c*, 5*d* can travel along the compensation curve 24*a*. The only exception to this is the very specific situation in which one joint 5*c* is at the one end position of the compensation curve 24*a* facing towards the sprocket 12, and the consecutive joint 5*d* is at the opposite end position of the compensation curve 24*a* facing away from the sprocket 12. In this specific angular sprocket position, where $\phi=\phi^*$, all the chain links 5*b* of the chain are fully stretched, i.e. extend in the linear direction of the linear chain section, and none of the chain links is deflected by the compensation curve 24*a*. Therefore the horizontal velocity difference $\Delta v=v-v_0=0$, i.e. in this specific position the whole chain section travels with the same (horizontal) velocity $v_0$. This results in $v_0=v$ and also $dl/dt=0$. In this position the horizontal length l(ϕ) has an extreme value, the maximum value, which results in $l(\phi^*)=l_{max}=2p$. From this position, l(ϕ) has to contract again, i.e. $dl/dt<0$, and the absolute value of v has to become smaller than $v_0$.

For determining the correct horizontal position (position in x-direction) of the end position of the compensation curve facing towards the sprocket 12, with respect to the origin of the sprocket 12, the following stringent conditions apply:

1. The horizontal projection of the compensation curve 24*a* has the length p of one chain link 5*b*.
2. The compensation curve 24*a* has to start at an angular position $\phi^*$ of the chain sprocket 12, where $\Delta v=v-v_0=0$. When one joint 5*c* is at the end position of the compensation curve 24*a* facing towards the sprocket, and the consecutive joint 5*d* is at the opposite end position of the compensation curve 24*a*, all the chain links 5*b* coupled by these joints 5*c*, 5*d* are in a horizontal, stretched, linear position and the horizontally projected chain length l reaches its maximum value $l(\phi^*)=2p$.
3. When a chain joint 5*d* travels along the compensation curve 24*a*, the horizontally projected chain length l(ϕ) shortens. When the chain joint 5*d* reaches the maximum vertical deflection of the compensation curve 24*a*, the horizontally projected chain length l(ϕ) shortens to its minimum. In this position of maximum deflection Δv=0. From this position of maximum deflection the horizontally projected chain length l(ϕ) begins to increase again until the joint 5*d* reaches the end of the compensation curve 24*a*. At the beginning of the compensation curve 24 and during the reduction of the horizontally projected chain length l(ϕ), the absolute value of v is smaller than $v_0$.
4. Under the condition that only one joint 5*d* of two adjacent chain links 5*b* is traveling along the compensation curve 24*a* at the same time and the other joints 5*c* of these links 5*b* are positioned on the linear track section, the horizontal distance $x_{B,St}$ between the end position of the compensation curve 24*a* facing towards the sprocket 12 (i.e the end of the compensation curve being closest to the sprocket) and the center of the sprocket 12 has to be larger or equal than $x(\phi^*)+p$, i.e. $x_{B,St}=x(\phi^*)+m\cdot'p$ (with m being any positive integer).

From the above considerations, an algebraic equation for the phase length $\phi^*$ can be derived. The phase length $\phi^*$ defines the end position $x_{B,St}$ of the compensation curve facing towards the sprocket. Among the solutions of such algebraic equation, only two fulfill the boundary condition for $v(\phi^*)=v0$ and therefore deliver valid solutions for the searched phase length $\phi^*$. One solution fulfills the equations in the way that the solution is not dependent on the angular direction and algebraic sign of the velocities. This is the valid solution for the searched $\phi^*$. The second solution delivers $\phi'^*$, which is the angle of the chain sprocket 12, where the joint 5*d* is maximum deflected (maximum y value) by the compensation curve 24*a* and $l(\phi)$ is at its minimum.

The projected length $l(\phi)$ is given by the following equations:

$$l(\varphi) = \frac{v_0}{\omega_0}\varphi - r\left[\sqrt{\left(\frac{p}{r}\right)^2 - (1-\cos\varphi)^2} - \sin\varphi\right] + C_1$$

with $$C_1 = 2p - \frac{v_0}{\omega_0}\varphi^* + r\sqrt{\left(\frac{p}{r}\right)^2 - (1-\cos\varphi^*)^2} - r\sin\varphi^*$$

For the calculation of the shape of the compensation curve 24*a* in between the end positions, two angle portions have to be differentiated. At the value $\phi=\phi^*$ one chain link 5*b* leaves the compensation curve 24*a* and the next link 5*b* is entering the compensation curve 24*a*. That circumstance separates the two angle portions and this has to be considered for the calculation of the coordinates $x'_B(\phi)$, $y'_B(\phi)$ of the compensation curve 24*a*. The resulting equations are:

$$x'_B(\varphi) = x(\varphi) + \frac{l(\varphi)}{2} - x_{B,St}$$

$$0 \le \varphi < \varphi^*$$

$$x'_B(\varphi) = x(\varphi) + \frac{l(\varphi)}{2} - x_{B,St} + p$$

$$\varphi^* \le \varphi < \alpha$$

$$y'_B(\varphi) = \sqrt{p^2 - \frac{l(\varphi)^2}{4}}$$

Figure 3A:
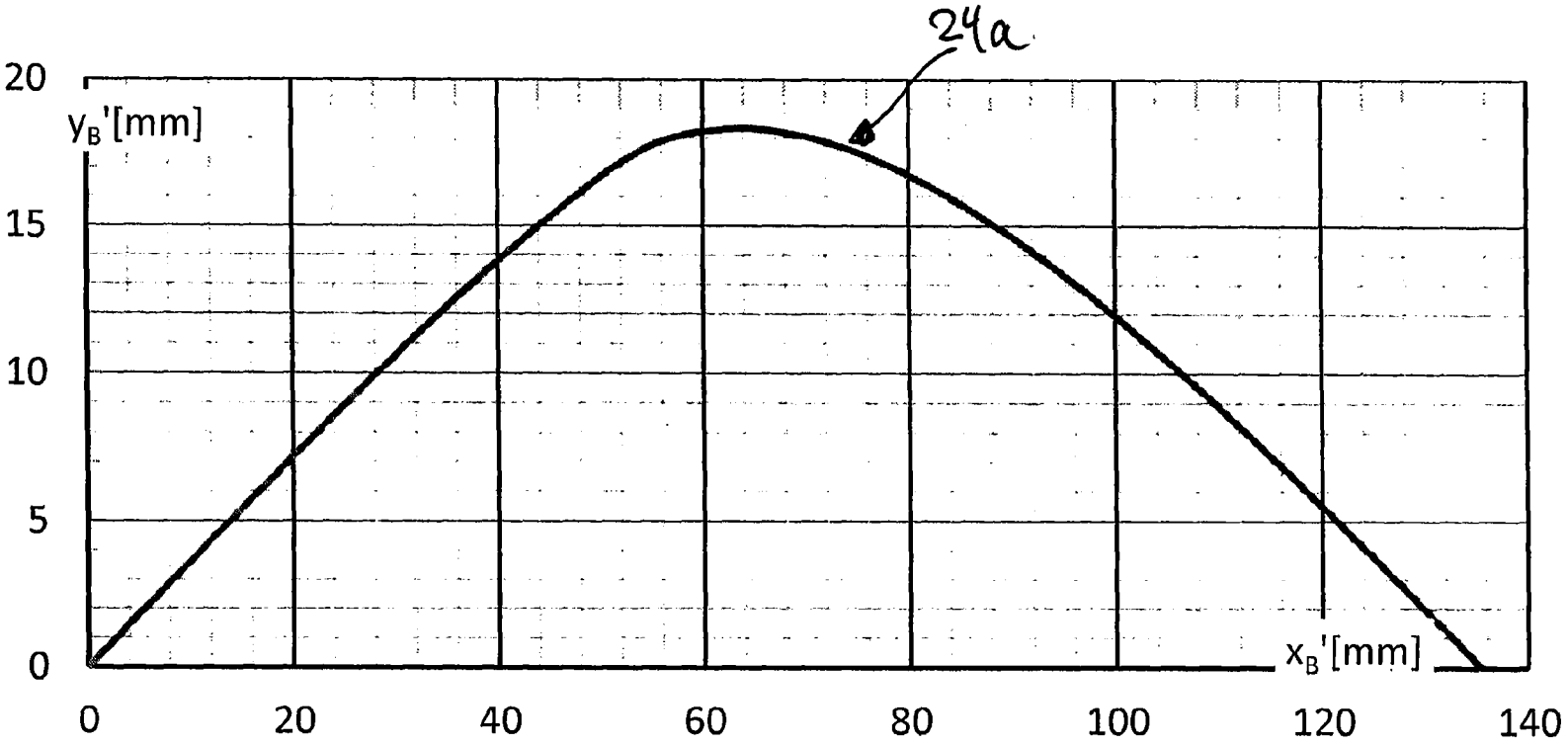
FIG. 3*a* shows an example of a calculated compensation curve in a linear portion of the chain track upstream of a sprocket rotating with constant angular velocity.

FIG. 3*a* shows an example of a compensation curve 24*a*, which has been calculated as described before, for a drive system having a sprocket 12 which rotates with constant angular velocity and p=135,466 mm, n=5.

It some embodiments, instead of a single compensation curve in the linear chain section, as described above, a plurality of compensation curves 24*a*1, 24*a*2, 24*a*3 may be provided in such linear chain section (see e.g FIG. 1). The compensation curves will have a distance to each other corresponding to multiples of the chain pitch p, such that each of the compensation curves will satisfy the boundary conditions established above. For given phase length $\phi$, τhe total change of the horizontally projected chain length $\Delta l(\phi)$ provided by all compensation curves must be same as described above for only one compensation curve. In case of a plurality of k identically shaped compensation curves, the change of the horizontally projected chain length $\Delta l_k(\phi)$ provided by each of the compensation curves can be determined as $\Delta l_k(\phi)=\Delta l(\phi)/k$ leading to the following expressions for the horizontally projected chain length $\Delta l_k(\phi)$ and the coordinates of the compensation curves:

$$l_k(\varphi) = 2p\left(1 - \frac{1}{k}\right) + \frac{l(\varphi)}{k}$$

$$x_{B'_k}(\varphi) = x(\varphi) + \frac{l_k(\varphi)}{2} - x_{B,St}$$

$$0 \le \varphi < \varphi^*$$

$$x'_{B_k}(\varphi) = x(\varphi) + \frac{l_k(\varphi)}{2} - x_{B,St} + p$$

$$\varphi^* \le \varphi \le \alpha$$

$$y_{B'_k}(\varphi) = \sqrt{p^2 - \frac{l_k(\varphi)^2}{4}}$$

Figure 2B:
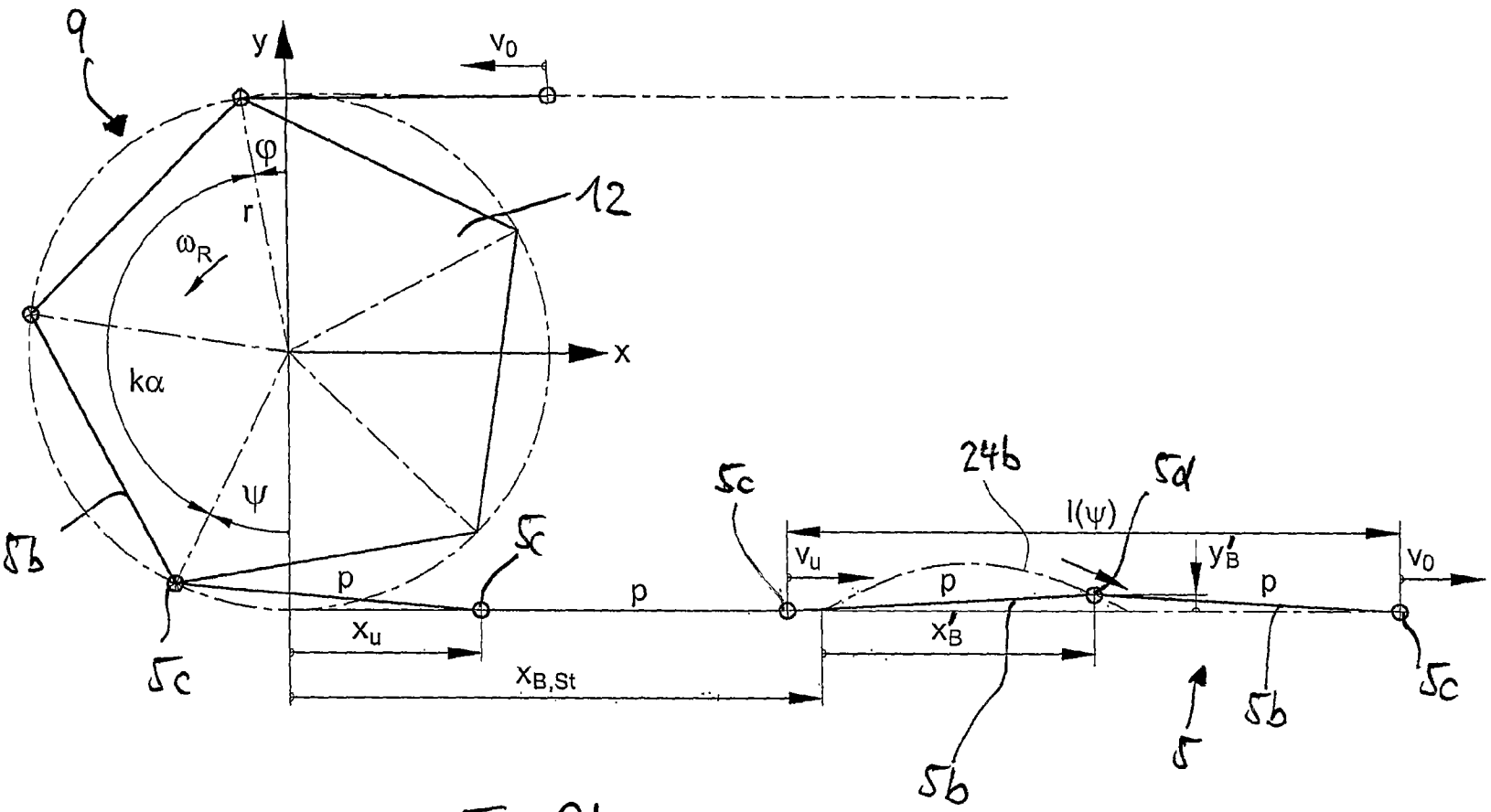
FIG. 2*b* illustrates a method of determining the compensation curve in a linear portion of the chain track downstream of a sprocket rotating with non-constant angular velocity.

Corresponding considerations apply with respect to compensation of a polygon effect occurring in the following linear chain section when the chain leaves a sprocket 12, or an otherwise bent portion of the chain track (e.g. a turnaround section or a transition section) as shown in FIG. 2*b* (i.e. in FIG. 2*b* in the lower linear chain section traveling from left to right). Typically, such linear chain section will be part of the return track. A compensation curve calculated analogously as described above may be provided in such linear chain section, e.g. the return track, in order to compensate for the polygon effect occurring when the chain links leave the sprocket 12.

Figure 3B:
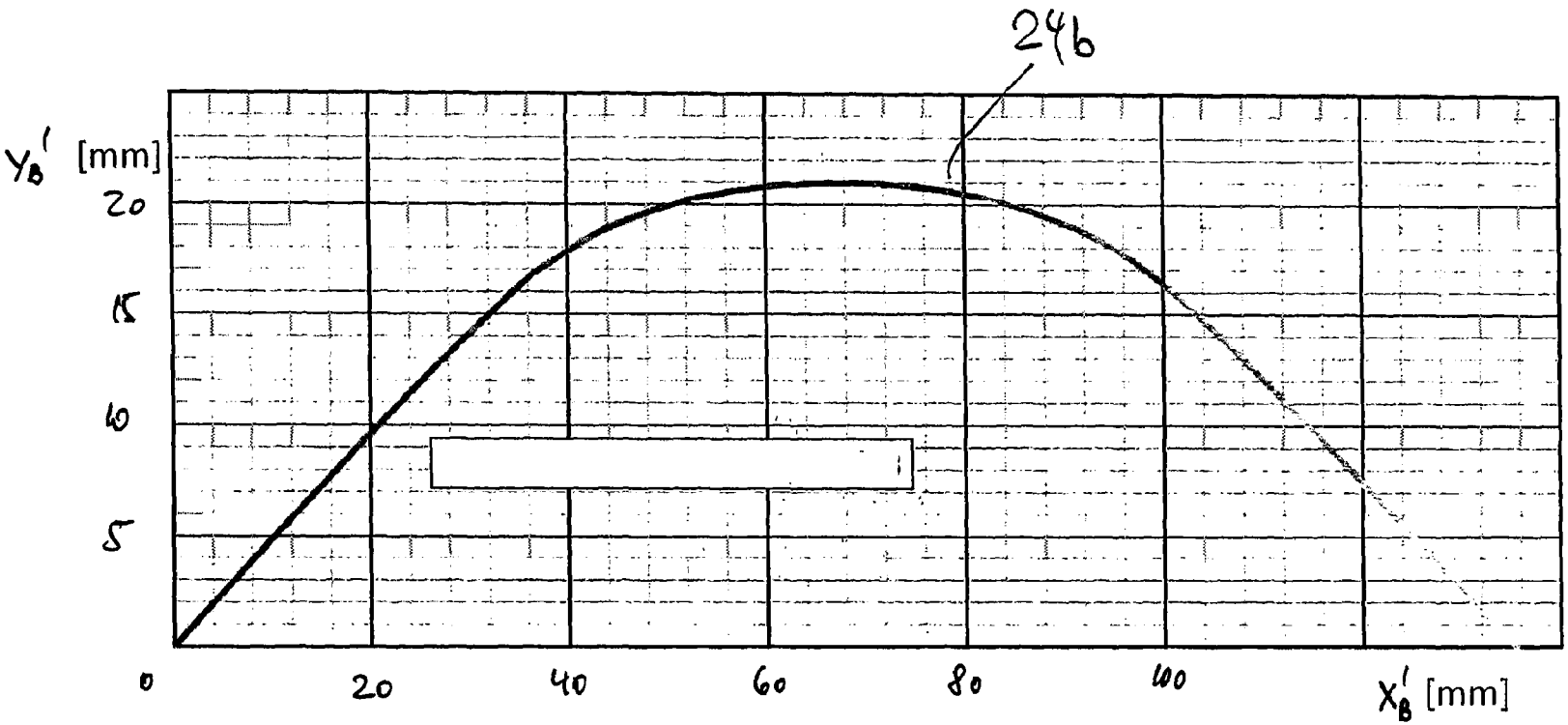
FIG. 3*b* shows an example of a calculated compensation curve in a linear portion of the chain track downstream of a sprocket rotating with non-constant angular velocity.

In a particular case, the sprocket 12 may be a drive sprocket rotating with non-constant angular velocity to compensate for a polygon effect occurring when the chain enters the sprocket 12, as described in WO 2012/161 691 A1. In such case compensation curves in the load track (upper track of FIG. 2*a*) could be avoided. However, it may still be advisable to provide compensation curves in the linear chain section leaving the sprocket 12, e.g. in the return section of a people conveyor, in order to compensate for the polygon effect occurring when the chain leaves the sprocket 12. The position and shape of such compensation curves 24*b* may be calculated using a similar approach as described above. The basic geometrical relationships are outlined in FIG. 2*b*, for the case of a sprocket 12 with an odd number of teeth. For the case of a sprocket 12 with an even number of teeth, the geometric relationships have to be modified slightly leading to somewhat different expressions for the location of compensation curve 24*b* with respect to the sprocket for sprockets 12 having even and odd teeth numbers, respectively. The shape of the compensation curve, i.e. its coordinates related to its starting point, will be the same for sprockets with an odd and even number of teeth. An example of the shape of such compensation curve (sprocket 12 rotating with non-constant angular velocity as described in WO 2012/161 691 A1, p=135,466 mm, n=5) is depicted in FIG. 3*b*. As can be seen from FIG. 3*b*, the compensation curve 24*b* in the linear chain section, e.g. in the return section, has a symmetrical shape with respect to the position of maximum deflection. The symmetrical shape of compensation curve 24*b* is due to the non-constant angular velocity of the sprocket. In contrast, the compensation curve 24*a* arranged in the linear section of FIG. 2*a* (sprocket 12 rotating with constant angular velocity, compensation curve is arranged in the linear chain section approaching the sprocket) has an asymmetrical shape with respect to the position of maximum deflection. The asymmetrical shape of the compensation curve 24*a* is a consequence of the constant angular velocity of sprocket 24*a*.

Also in case of the compensation curve 24*b* arranged in the linear chain section leaving the sprocket, as shown in FIG. 3*b*, it is conceivable to provide a plurality of compensation curves instead of only one compensation curve. This is particularly advantageous in case the linear section is the return section of a conveyor, as there is no load to be transported in the return section. For designing the position and shape of multiple compensation curves, the same considerations apply as outlined above with respect to FIG. 2*a*, 2*b*.

Further, a compensation curve may be provided in a non-linear, i.e. curved or bent section of the chain track. Such curved section may be a turnaround section of the endless loop, or any other bent section, e.g. transition regions of a conveyor, like an escalator, where the conveying direction changes from an inclined orientation towards a horizontal orientation. Using the principles for designing compensation curves in linear chain sections set out above, it is particularly elegant to design compensation curves arranged in curved or bent section of the step chain track by geometrical transformation.

In the following it will be explained with reference to FIG. 2*c*, how a compensation curve 24*b* located in the linear portion of the track is transformed to a compensation curve 24*c* located in the bent turnaround section 9, 10.

Figure 2C:
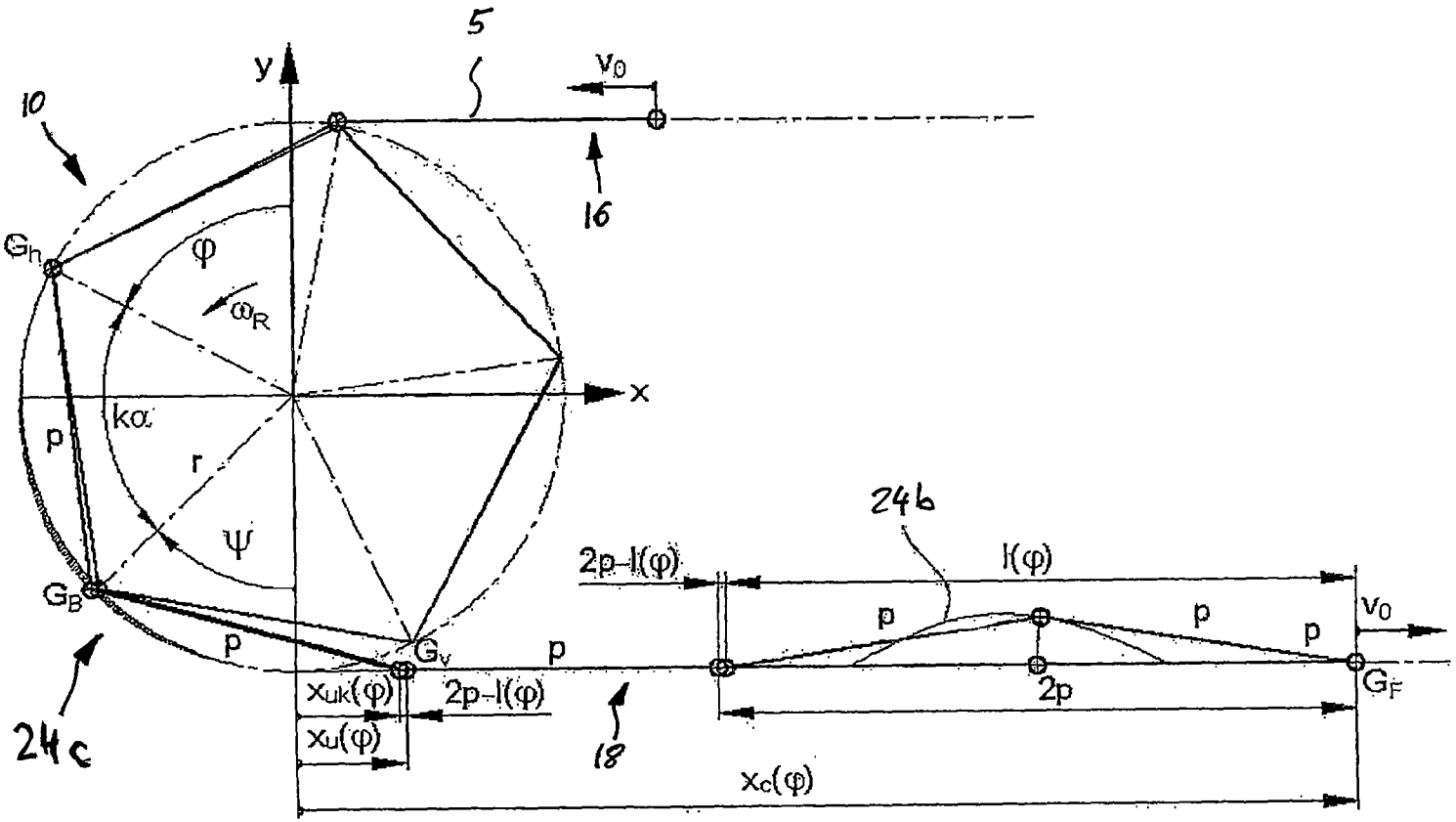
FIG. 2*c* illustrates a method of determining the compensation curve in a curved turnaround portion of the chain track.

A chain joint $G_F$, which is shown in the lower right part of FIG. 2*c*, is the first "depolygonized' chain joint traveling with constant speed $v=v_0$ on the linear return track 8 (in FIG. 2*c* such chain joint is traveling from left to right direction in the return track 8 in normal operation). A compensation curve 24*b* located in the linear portion of the return track 8 is indicated in the bottom of FIG. 2*c*. If such compensation curve 24*b* for a linear chain track section is to be substituted by a compensation curve 24*c* for a curved chain track section, e.g. a track section formed in the second turnaround section 10, it is necessary that the position of $G_F$ remains the same for all values of the angle $\phi$. When the joint $G_F$ is fixed in its 'depolygonized' position and the chain 5 is stretched backwards along the linear track 18 to the second turnaround section 10, the adjacent joint $G_v$ is moved by the distance $2p-l(\phi)$ against the travel direction of the chain (to the left in FIG. 2*c*) resulting in a new position $x_u \rightarrow x_{uk}$.

Another constraint to the movement of the step chain results from the consideration that also the joint $G_h$, which is positioned in the upper half of the second turnaround section 10 close to the load track 7, shall stay where it has to be in order to fulfill the requirement of a constant velocity $v=v_0$=const. for the chain 5 in the load section 8.

Combining these two constraints results in the finding that the joint $G_B$ is not positioned on a virtual circular line located in the second turning section 10, but is slightly shifted from such a virtual circle in radial direction to the outside. For each angle $\phi$, the desired position of $G_h$ can be exactly determined and the moved position of $G_F$ can be determined. With these two positions known, the position of $G_B$ can be determined, as well, since $G_v$, $G_h$ and $G_B$ form a triangle with two sides having the length p of the chain links and one side having the length $G_v$–$G_h$. The calculated course of $G_h$ in the lower left quadrant of the second turning section 10, therefore describes the searched compensation curve 24*c*.

From the two constraints mentioned before, an analytic formula describing the compensation curve 24*c* in at least a portion of second turnaround section (turnaround compensation portion) may be derived. The analytic expression for the compensation curve 24*c* may be different for sprockets 12 having even and odd teeth numbers, respectively. The analytic expression for the compensation curve 24*c* may further be different in various portions of second turning section 10. By combining a plurality of analytic formulas, each of which defines at least a portion of the compensation curve 24*c*, an analytic expression covering the whole length of the compensation curve 24*c* in second turning section 10 may be achieved.

Figure 6:
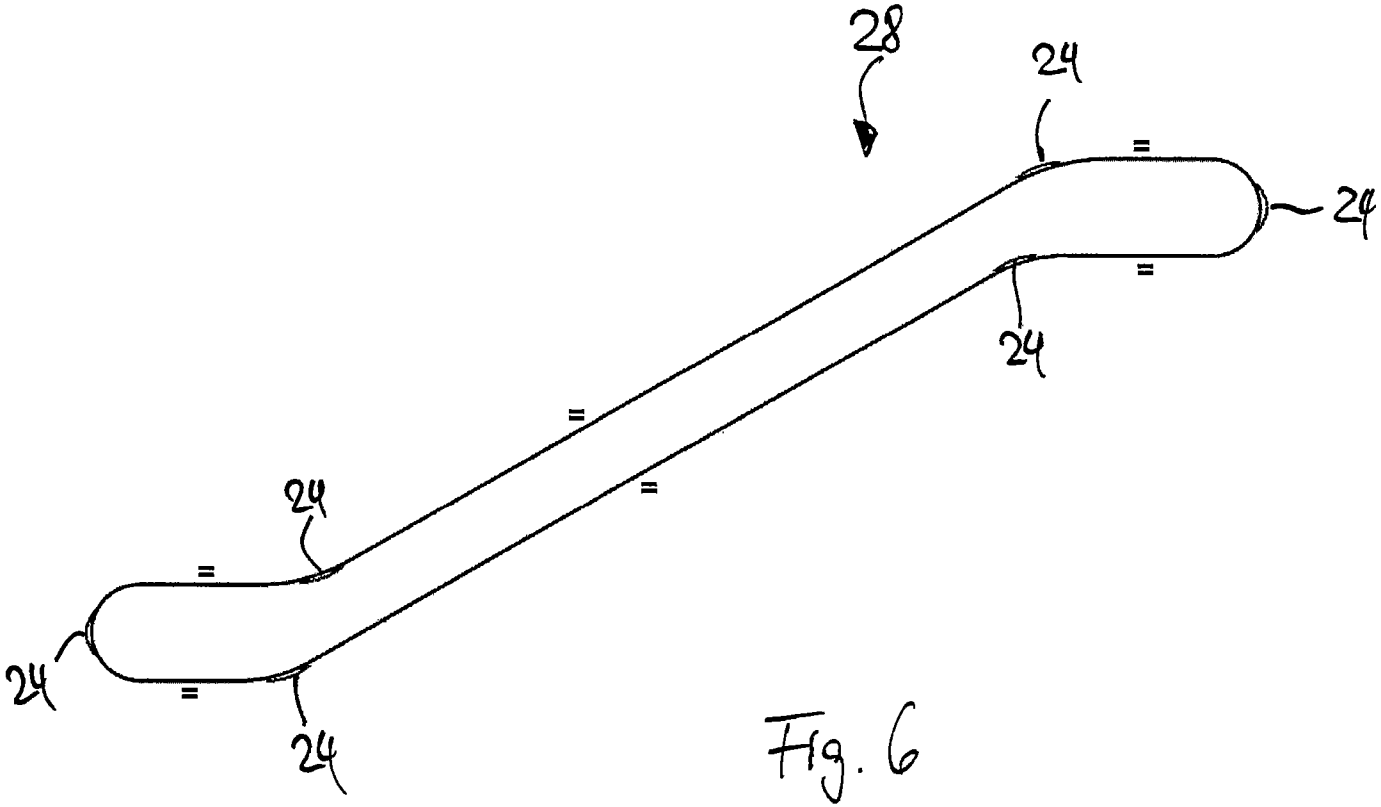
FIG. 6 is a simplified schematic drawing showing location of various compensation curves distributed along the chain track of the step chain of an escalator.

The compensation curve 24*c* for the turnaround section 10 may be provided by calculating the compensation curve 24*b* for a linear portion 7, 8 of the loop 6 and transforming said linear compensation curve 24*b* into a compensation curve 24*c* for the turnaround section to be located in at least one portion of the turnaround section 10. Resolving the compensation curve 24*b* for the linear chain track section completely exactly allows to transfer this knowledge to other, almost arbitrary geometric track situations, like the return bow (second turnaround section 10) of the loop 6 and any otherwise bent track portions. It is also possible to transform the compensation curve 24*b* for a linear track section into a compensation curve 24*c* for a bent track section arranged in one of the transition regions of a conveyor, like an escalator as depicted in FIG. 6. Alternatively, it is possible to design the compensation curve 24*c* located in the turnaround section by first calculating a compensation curve 24*a* in the straight section of the chain track upstream or downstream of a sprocket rotating with constant angular velocity, and applying an analogous transformation. This new method of constructing the compensation curve 24*c* for a bent or curved track section further provides information where to start and to end the compensation curve 23*c* for the bent or curved track section.

Figure 3C:
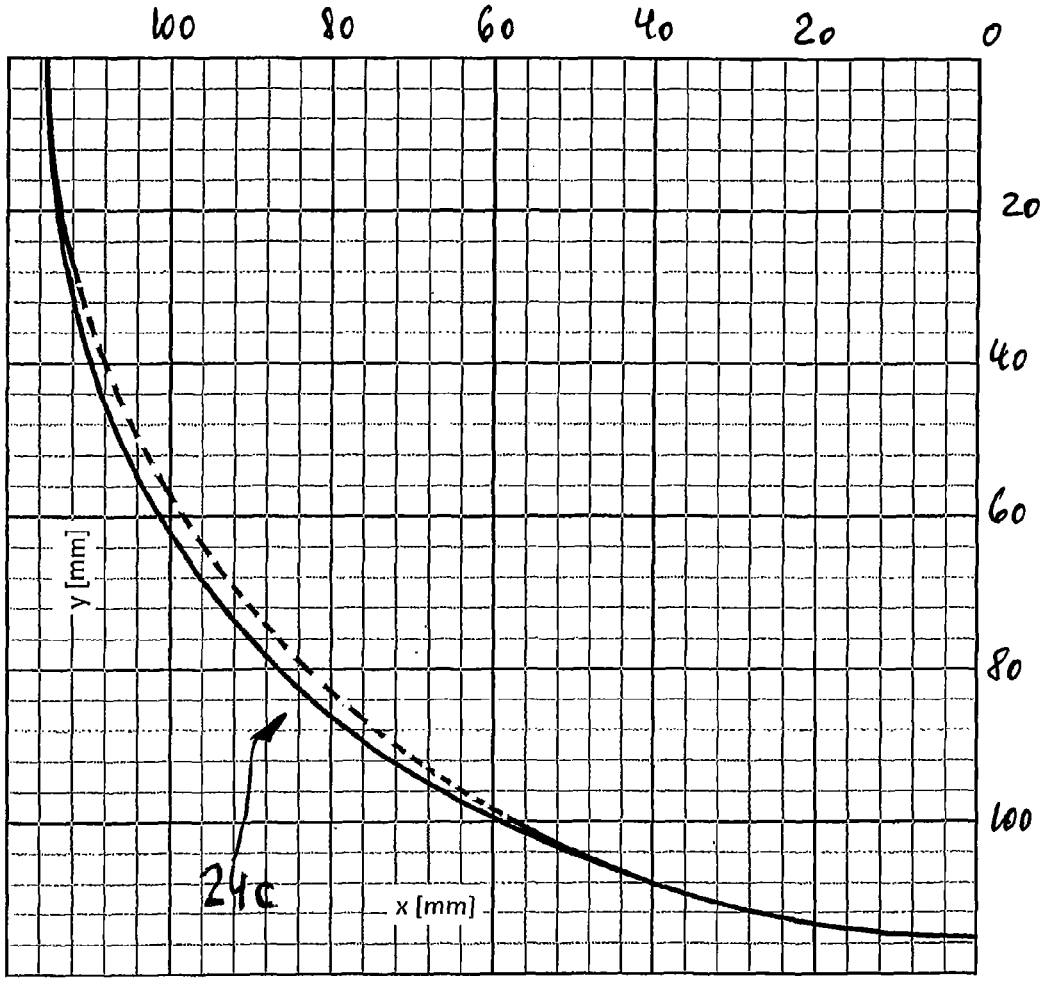
FIG. 3*c* shows an example of a calculated compensation curve in a curved turnaround portion of the chain track.

FIG. 3*c* shows an example of a compensation curve 24*c* for a bent or curved track section in a turnaround section (straight line). The compensation curve 24*c* has been calculated as described before, in relation to a circular return arc (dashed line) for a system having a chain link length of p=135,466 mm and a drive sprocket 12 comprising five teeth (n=5).

Figure 4:
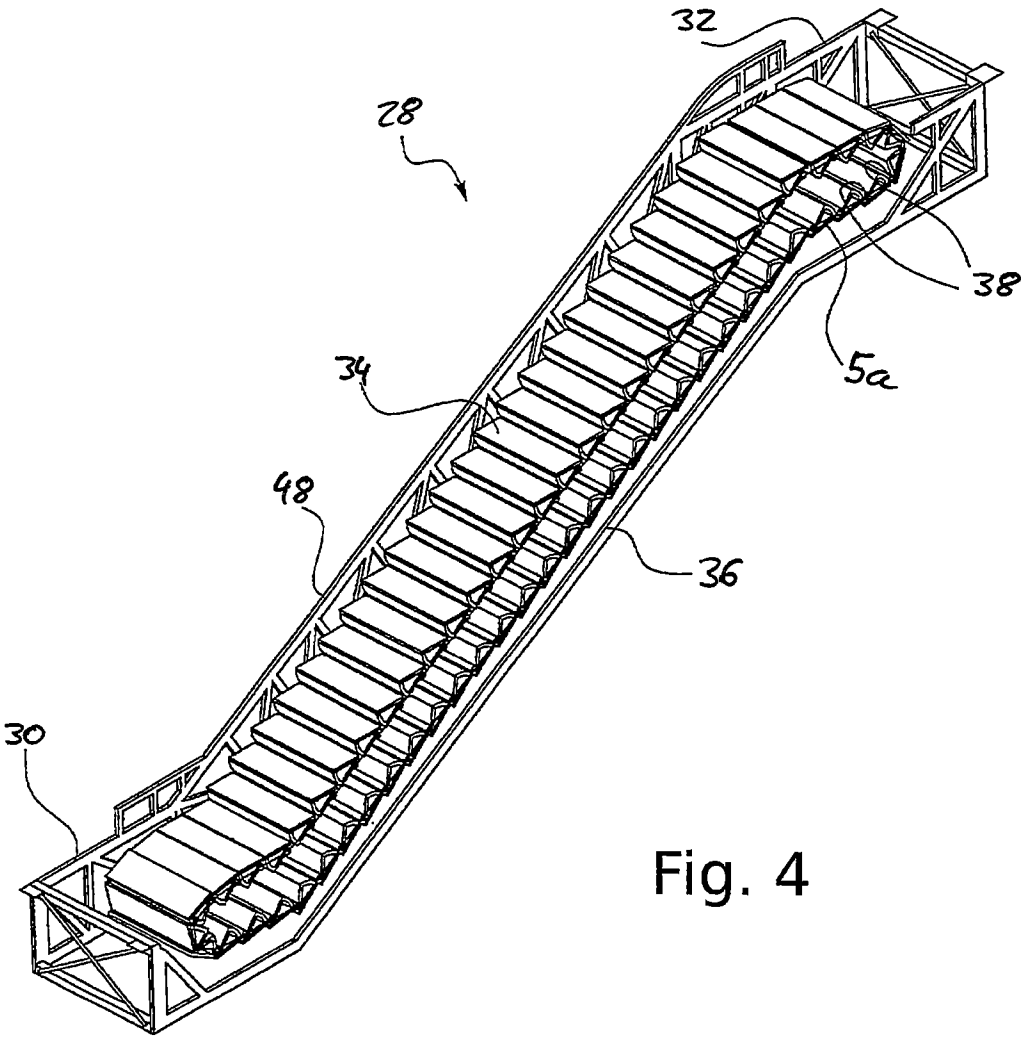
FIG. 4 shows an exemplary passenger conveyor system comprising a chain drive according to an embodiment of the invention.

Referring to FIG. 4, an exemplary passenger conveyor system 28 in accordance with at least some embodiments of the present disclosure is shown.

Although the shown passenger conveyor system 28 is an escalator, it is to be understood that the passenger conveyor system 28 is representative of various types of chain driven mechanisms that engage a drive chain 5 having discrete links engaged with a toothed drive sprocket 12. Furthermore, the passenger conveyor system 28 need not always be at an inclined one as shown. Rather, in at least some embodiments, the passenger conveyor system 28 may be horizontal as in a moving walk, curved, spiral or may define any other commonly employed configuration. The compensation system described herein is operable in other types of chain drives as well, in particular for conveyor system for transporting persons and/or any kind of goods.

A typical passenger conveyor system 28 of the type that may be employed for purposes of the present disclosure may include a bottom landing 30 connected to a top landing 32 via a plurality of steps (also referred to as treads) 34 and a truss 36. A step chain 5*a* having a plurality of step chain links 38 may be engaged with the plurality of treads 34 to drive and guide those treads 34 in an endless loop by rotation of a step chain sprocket 12, which is not visible in FIG. 4, between the top landing 32 and the bottom landing 30. The passenger conveyor system 28 may further include a pair of moving handrails (not shown) supported by a balustrade 48 of the truss 36.

Figure 5:
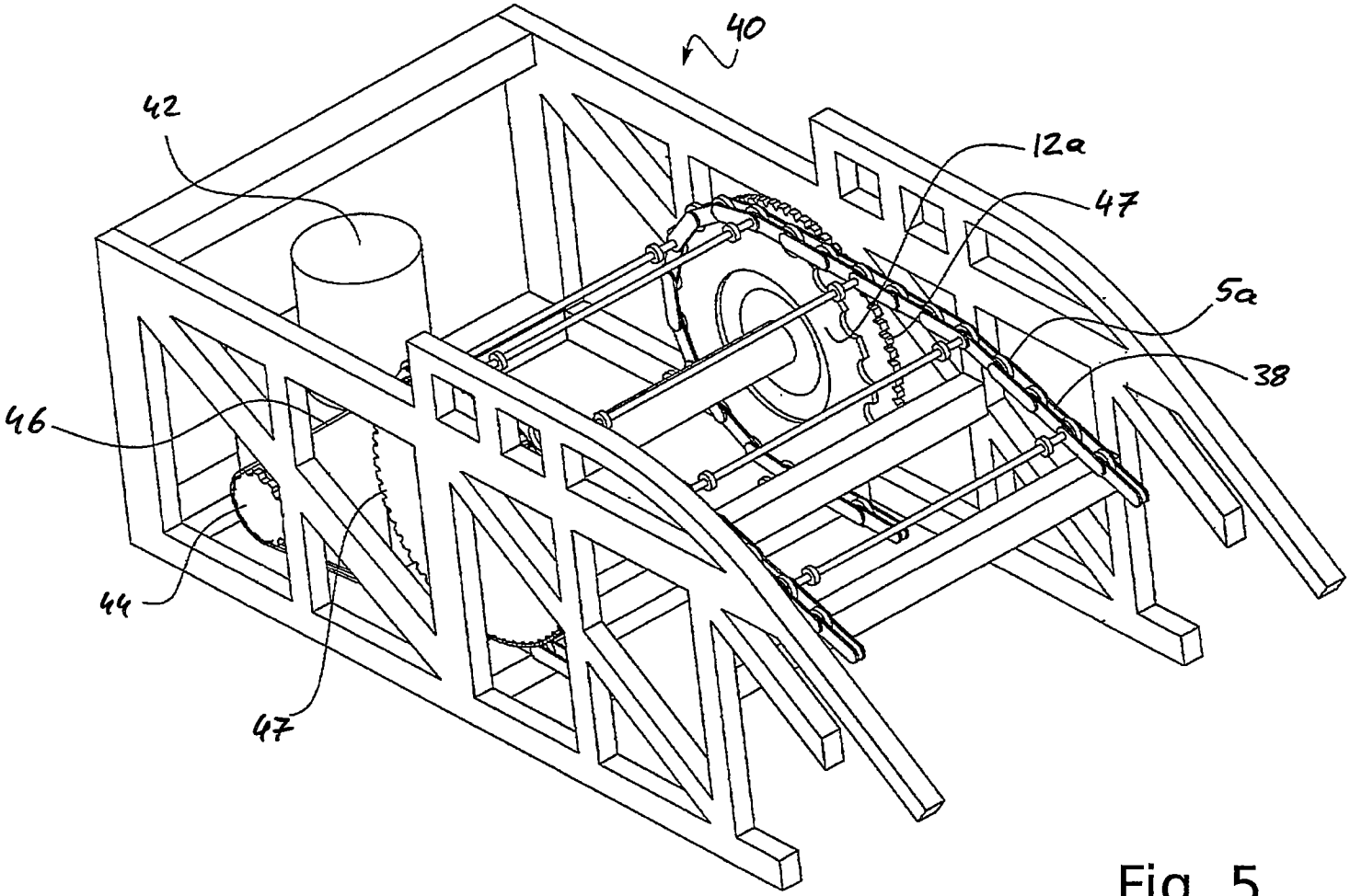
FIG. 5 shows the drive module of the passenger conveyor system shown in FIG. 4.

FIG. 5 shows an example of a drive module 40 of the passenger conveyor system 28 shown in FIG. 4. The drive module 40 may be provided beneath the top landing 32 and may include a motor 42, which may at least indirectly drive a main drive shaft having a machine drive chain sprocket 44. The machine drive chain sprocket 44 in turn may drive a main drive chain 46 to which is engaged a main drive chain sprocket 47. The main drive chain (MDC) sprocket 47 may engage with, and rotate concurrently with, the step chain (STC) sprocket 12*a* to move the step chain 5*a*.

FIG. 6 shows in schematic form where compensation curves (24*a*, 24*b*, 24*c*; in the following simply referred to as 24) as described herein may be useful in case of an inclined conveyor like an escalator 28. A polygon effect will occur anywhere where the chain 5 travels along a curved or bent portion of the track, in particular a polygon effect will occur in the upper and lower turnaround portions or in the transition portions where the direction of travel of the conveyor (and thus the direction of travel of the chain 5) changes from an inclined direction towards a horizontal direction or vice versa. Velocity fluctuations caused by the polygon effect will be particularly strong in the turnaround section, but may also be considerably strong in the transition regions in case of conveyors using a large pitch chain, e.g. in case of escalators having only on step chain link associated with each step. The polygon effect In each of those curved track portions, a polygon effect occurs both when the chain enters the curved portion of the track and when the chain leaves the curved portion of the track. To compensate such polygon effect, in order to avoid velocity fluctuations associated therewith, compensation curves 24 may be provided at each of these curved portions. Such compensation curves 24 may be any of the compensation curves 24*a* in the upstream linear track section as described with reference to FIG. 2*a*, 3*a*, compensation curves in the downstream linear track section as described with reference to FIG. 2*b*, 3*b*, or bent compensation curves with the bent sections of the track as described with reference to FIGS. 2*c*, 3*c*. The three different types of compensation curves may also be combined if desired. In case of a drive sprocket 12 it is also conceivable to provide a polygon effect compensation, e.g. with respect to the polygon effect caused by the chain section entering the sprocket 12, by driving the sprocket with a non-constant angular velocity, as described in WO 2012/191 991 A1. As a result, a chain traveling with constant velocity essentially in all parts of its chain track can be achieved. This is indicated by the symbols "=" which are depicted upstream and downstream of all bent portions of the closed loop.

Notwithstanding the components of the passenger conveyor system 28 described above, it will be understood that several other components, such as, gearbox, brakes, etc., that are commonly employed in passenger conveyor systems are contemplated and considered within the scope of the present disclosure. It will also be understood that while several of the components, such as, the machine drive chain sprocket 44 and the main drive (MDC) sprocket 47 of the drive module 40 described above are driven by chains, in at least some embodiments, one or more of those components may be driven by belts or other commonly employed mechanisms. Furthermore, in at least some embodiments, the main drive shaft may directly drive (by way of belts or chains) the MDC sprocket 47, without the usage of the machine drive chain sprocket 44 and the main drive chain 46. In yet other embodiments, the main drive shaft may directly drive (by belts or chains) the STC sprocket 12*a* without the usage of the machine drive chain sprocket 44 or the MDC sprocket 47.

Although described with respect to a conveyor, polygon compensation as described herein is usable with any type of chain drive. A particular benefit is for chain driven conveyor systems.

In a chain drive according to exemplary embodiments of the invention, a polygon compensation system for compensating the polygon effect of the chain comprises at least one component located within at least one of the turnaround sections and/or in at least one of the load track and the return track of the closed loop. The closed loop forms the chain track including first and second turnaround sections as well as a load track and a return track connecting the turnaround portions. The load track and/or the return track may include linear chain track sections as well as curved or bent chain track sections, e.g. in the transition regions of an escalator. The turnaround sections typically include curved track sections.

Such a polygon compensation system allows for effectively compensating the polygon effect of the chain drive. If the components of the compensating system are arranged in the turnaround sections, it is not necessary to provide curved compensation portions, which reduce the usable length of the track, in the load track and/or in the return track in order to compensate the polygon effect caused by the turnaround sections. As a result, the usable length of the chain drive is enhanced compared to a chain drive comprising conventional compensation curves in the linear portions of the track, such enhancement being achieved without increasing the total length of the chain drive. In consequence, chain driven conveyors, such as escalators or moving walkways, may be built up which need only little space in addition to the length of transportation. The cost for installing the conveyor may be reduced. This kind of conveyor is in particular beneficial if the available space is restricted.

Particular embodiments of such polygon compensation system may include any of the following features, alone or in combination:

In any embodiments, the polygon compensation system may comprise a compensation curve formed along at least a portion of a turnaround section and/or at least one compensation curve formed along at least a portion of at least one the load track and the return track. A compensation curve located in at least a portion of a turnaround section provides an effective means for compensating the polygon effect without increasing the length of the chain drive. Similarly, the return track of a conveyor provides sufficient space for accommodating a compensation curve, or a plurality of compensation curves, for compensating the polygon effect without increasing the length of the chain drive. Even in the load track some sections exist, where compensation curves may be provided without disturbing ride quality, e.g. in the vicinity of the turnaround sections.

In any of the embodiments described herein, the compensation curve may be defined so that the chain entering the turnaround section, or the otherwise bent portion of the chain track, with constant velocity leaves the turnaround section, or the otherwise bent portion of the chain track, with constant velocity. Such arrangement allows to maintain a constant velocity of the chain in all portions of the chain track.

In any of the embodiments described herein, the compensation curve may extend within a curved compensation portion of the turnaround section, or of the otherwise bent track portion, the compensation curve being defined within the curved compensation portion by at least one analytic formula. Using an analytic formula allows to construct and form the compensation curve very economically and efficiently.

The compensation curve in the curved compensation portion may by calculated by transforming a compensation curve, which has been calculated for a linear portion of the chain track, into a curved compensation curve to be located in a curved compensation section of the chain track, e.g. in the turnaround sections or in transition sections. Resolving the linear compensation curve completely exactly by means of an analytic formula allows to transfer the knowledge to almost any arbitrary geometric situations of the chain track, like the return bow (turnaround section leading from the load track to the return track). It further allows to determine conveniently where to start and to end the compensation curve.

The analytic formula may be derived from geometric constraints of the chain links traveling along the turnaround section, or traveling along the otherwise bent track portion, and the requirement that the velocity of the chain links entering and leaving the turnaround section, or the otherwise bent track portion, is constant over time. The analytic formula may depend on the length of the chain links, the radius of the turnaround section(s), or the radius of the otherwise bent track portion(s), and the pitch of the chain links. In case of a sprocket, the analytic formula may also depend on the number of teeth of the sprocket. It in particular will depend on the number of chain links simultaneously located in the turnaround section(s) and on the fact whether this number is even or odd.

In any embodiments, the curved compensation portion may be composed of a plurality of curved compensation portions. In such case, the analytic formula for the compensation curve may be defined piecewise within each of the curved compensation portions. Providing different analytic formulas for different portions of the curved portion allows to compensate the polygon effect very efficiently and facilitates the set-up of the analytic formula.

In any embodiments, the chain drive may comprise at least one compensating section in the load track of the loop and/or in the return track of the loop, in order to compensate for the polygon effect generated by the drive sprocket. Typically, such drive will include at least one compensating section in the load track and/or in the return track, together with at least one compensating portion in a curved portion of the chain track. In such way, polygon effects caused by the chain entering and leaving curved or bent portions of the chain track (e.g. velocity fluctuations induced in the load track and in the return track by the chain entering a sprocket or turnaround section and the chain leaving the sprocket or turnaround section) can be elegantly compensated for in order to achieve an essentially constant travel velocity of the chain around the closed loop.

In any embodiments, the chain drive may comprise at least one compensating section in the return track of the loop in order to compensate for the polygon effect generated by the drive sprocket. An additional compensating section may be provided in the load track and in the the return track, respectively.

In further embodiments, a plurality of compensating sections may be arranged in the load track and/or a plurality of compensating sections may be arranged in the return track. Splitting the compensation curve into a plurality of compensation curves may provide an effective means for compensating for the polygon effect generated by the drive sprocket and at the same time reducing wear of the chain by reducing the deflection of the chain links and joints in the compensation curves.

In principle, a single, appropriately shaped compensating section arranged in the load track and in the return track, respectively, would be sufficient for compensating the polygon effect. However, in case of splitting the compensation into a plurality of compensating sections arranged in the load track and/or in the return track, the amount of deflection of the chain in each of the compensating sections may be smaller as in the case in which only a single compensating section per track is used. Using a plurality of compensating sections instead of a single compensating section allows to reduce the deflecting angle of the chain links caused by each of the compensation curves and the force acting on the links and joints of the chain. In consequence, the additional load acting on the chain, which is caused by the compensation curves, can be reduced.

In particular embodiments, the drive may comprise a drive sprocket located in a first turnaround section of the loop. Driving the chain by means of a drive sprocket is a suitable and reliable method of driving the chain.

In other embodiments, the drive may comprise a drive located in at least one of the load track and the return track, in particular in a linear section of at least one of the load track and the return track, as it is disclosed e.g. in U.S. Pat. No. 3,677,388. Such a drive provides an alternative means for driving the chain; and a compensation system, as it has been described before, is suitable to be used in combination with such a drive system, as well.

In particular embodiments, the drive may be configured to operate with constant velocity, which allows to drive the chain very easily by means of a simple drive mechanism. In such drive the polygon compensation system may comprise at least one compensation curve located either upstream of said drive sprocket, downstream of said drive sprocket, or even both upstream and downstream of said drive sprocket. As outlined above, in case of a single compensation curve upstream and/or downstream of a sprocket rotating with constant angular velocity typically the compensation curve will have an asymmetrical shape with respect to its extension along direction of the chain track. In case asymmetrical compensation curves are provided in the upstream as well as in the downstream track sections, these compensation curves will be oriented symmetrically to each other with respect to the sprocket. The polygon compensation system further may comprise at least one compensation curve located upstream and/or downstream of any bent or curved section of the chain track. Similarly to the above, such compensation curve may have an asymmetrical shape with respect to its extension along direction of the chain track.

In further embodiments, the drive may be configured to operate with non-constant velocity in order to compensate for the polygon effect in at least one section of the closed loop. This allows to abstain from providing curved sections for compensating the polygon effect in the load and/or return sections of the loop, or at least reduces the amount of such curved compensation sections. Therefore, such measure enhances the usable length of the loop. The drive may be configured in particular to operate with a non-constant velocity compensating the polygon effect in the load section of the loop. As outlined above, for such chain drive the polygon compensation system may comprise at least one compensation curve located downstream of said drive sprocket and having a symmetrical shape.

In an embodiment, the drive may comprise a drive sprocket which is driven by means of a polygon compensation system in order to provide the non-constant rotation of the drive sprocket, which is suitable for compensating the polygon effect.

Said polygon compensation system may be an electronic drive system which is configured to control a motor driving the sprocket to rotate with non constant velocity, the non-constant rotation of the sprocket compensating the polygon effect. Examples of electronic drive systems, which may be used in combination with the embodiments of the present invention, are for example described in U.S. Pat. No. 6,351,096 B1 and WO 01/42122 A1.

Alternatively, a polygon compensation coupling system may be arranged between the motor and the sprocket. The polygon compensation coupling system may be a mechanical system. In this case, the motor is configured to rotate with constant velocity and the polygon compensation coupling system is configured to transform the constant rotation of the motor into a non-constant rotation driving the sprocket. An example of a mechanical polygon compensation coupling system, which is configured to transform a rotation with constant velocity into a rotation with non-constant velocity in order to compensate the polygon effect and which may be used in combination with the embodiments of the present invention, as they have been described before, is e.g. disclosed in WO 2012/161691 A1.

In the embodiments set out above, in designing a polygon compensation system for compensating the polygon effect in an endless chain drive including a chain configured to rotate in a closed loop forming a load track and a return track interconnected by first and second turnaround section, a strategy to be followed basically involves the following major steps: A first step involves designing at least one component of the polygon compensation system located in at least one straight section of the closed loop. Such component may be a compensation curve located in a straight section of the closed loop and designed such as to compensate a polygon effect occurring in a downstream and/or upstream curved/bent section of the closed loop. In a second step, the compensation component obtained in the first step is subjected to a transformation, in particular a geometric transformation. The type of transformation to be applied depends on the desired effect: Applying a first type of transformation may result in moving said at least one component located in said straight section along the closed loop to form a compensation component located at least partly in a curved section of the closed loop. Alternatively, or additionally, applying such transformation may result in splitting said at least one component located in a straight section into at least two components arranged within the closed loop. The inventors have found that a polygon compensation system is most effective in case it includes a variety of compensating components located at various places along the closed loop. The method according to the embodiment described herein provides for an elegant formalism that allows to conveniently calculate a polygon compensation required in a particular section of the closed loop, and then distribute the polygon compensation to locations along the closed loop most suitable for a particular application. Distribution may include the movement of compensating components along the closed loop and/or the splitting of compensation components into as much compensating components as necessary. The formalism allows the compensating components to be located anywhere. It is particularly beneficial to locate compensating components in curved sections as well as in straight sections.

Particularly, said at least one component of said compensating system obtained in said first step may be a compensation curve adapted to compensate the polygon effect caused by the chain entering and/or leaving at least one of the a load track, return track, first and second turnaround sections. Such compensation curves may be provided by guiding mechanism forcing the chain links to follow a predetermined compensation curve. However, as described above, the present method allows to realize the polygon compensation by forming another equivalent compensation curve in a different section of the closed loop, typically a curved section, and/or by providing a plurality of consecutive compensation curves. Such procedure effectively allows to keep chain deflection to a minimum and to place chain deflection at locations along the closed loop where they affect transportation to a minimum. Nevertheless, almost each adverse polygon effect can be compensated, even for small diameter sprockets and large chain pitch.

In particular embodiments, the step of subjecting said least one component located in said straight section to said transformation may result in moving said component from said straight section of said closed loop into a moved compensation component located in a curved section of said closed loop. This provides a relatively easy and convenient way of designing compensation components, in particular compensation curves, for curved section of the closed loop, e.g. with the turnaround sections or within transition sections. Such compensation curves often require a significantly lower deflection for a given polygon effect, compared to a compensation curve in the straight section. The transformation for moving the compensation curve into a curved section of the closed loop may involve modifying a shape of said compensation component according to a curvature of said curved section of said closed loop, as described in more detail above.

The invention also may include a conveyor system comprising a chain drive according to exemplary embodiments of the invention, wherein the chain is a step chain of the conveyor system. The conveyor system in particular may be configured for passenger transportation, e.g. in the form of an escalator or moving walkway.

REFERENCE NUMERALS

1 chain drive
2, 4 curved section
5 chain
5*a* step chain
5*b* chain link
5*c*, 5*d* chain joints
6 loop
7 load track
8 return track
9 first turnaround section
10 second turnaround section
12 drive sprocket
12*a* step chain sprocket
16, 18 sections with constant velocity
20, 22 sections with non-constant velocity
24 polygon compensation curve
24*a* polygon compensation curve in the linear chain section upstream of sprocket or otherwise bent track portion

24*b* polygon compensation curve in the linear chain section downstream of sprocket or otherwise bent track portion
24*c* polygon compensation curve in curved section of turnaround section or otherwise bent track portion
28 passenger conveyor system
30 bottom landing
32 top landing
34 steps/treads
36 truss
38 step chain links
40 drive module
42 motor
44 machine drive chain sprocket
46 main drive chain
47 main drive chain (MDC) sprocket
48 balustrade

The invention claimed is:

1. A chain drive comprising:

a chain configured to rotate in a closed loop forming a load track and a return track interconnected by first and second turnaround sections;

a drive which is arranged in the first turnaround section for driving the chain;

wherein the second turnaround section comprises a stationary turnaround structure which is configured to reverse the direction of travel of the chain by 180 degrees, the stationary turnaround structure extending at least partially along a polygon compensation curve designed for compensating the polygon effect of the chain traveling along the loop providing a polygon compensation system.

2. The chain drive of claim 1, wherein the polygon compensation system comprises at least one compensation curve formed along at least a portion of the second turnaround section.

3. The chain drive of claim 2, wherein the compensation curve is defined so that the chain entering t h e second turnaround section, with constant velocity leaves the second turnaround section, or otherwise bent portion of the chain track, with constant velocity.

4. The chain drive of claim 3, wherein the at least one compensation curve extends in a linear compensation portion of the chain track, the compensation curve being defined within the linear compensation portion by at least one analytic formula.

5. The chain drive of claim 3 wherein a plurality of compensation curves extend in at least one of the load track and the return track of the closed loop.

6. The chain drive of claim 2, wherein the compensation curve extends within a curved compensation portion of the chain track, in particular within a turnaround compensation portion of the second turnaround section and/or within a bent track portion formed in a transition region, the compensation curve being defined within the curved compensation portion by at least one analytic formula.

7. The chain drive of claim 6, wherein the compensation curve is defined piecewise within the curved compensation portion by at least one analytic formula per subportion of the curved compensation portion.

8. The chain drive of claim 6, wherein the compensation curve is obtained by a mathematical transformation of a compensation curve calculated for a linear portion of the chain track, into a curved compensation portion compensation curve to be located in a curved portion of the chain track, in particular the second turnaround section of the loop and/or in a transition region of the loop.

9. The chain drive of claim 1, wherein the drive comprises a drive sprocket located in the first turnaround section of the loop.

10. The chain drive of claim 9, wherein the drive sprocket is configured to rotate with constant angular velocity.

11. The chain drive according to claim 10, wherein the polygon compensation system comprises at least one compensation curve located upstream and/or downstream of said drive sprocket, said compensation curve having an asymmetrical shape.

12. The chain drive of claim 9, wherein the drive sprocket is configured to rotate with non-constant angular velocity in order to compensate for the polygon effect in at least one section of the closed loop.

13. The chain drive according to claim 12, wherein the polygon compensation system comprises at least one compensation curve located downstream of said drive sprocket, said compensation curve having a symmetrical shape.

14. The chain drive of claim 12, wherein the drive sprocket is driven by means of a polygon compensation coupling system.

15. The chain drive of claim 1, wherein the drive comprises a drive located in at least one of the load track and the return track of the loop.

16. A conveyor system comprising a chain drive according to claim 1, the chain being a step chain of the conveyor system.

17. The conveyor system of claim 14 being configured for passenger transportation.

18. A method of operating a conveyor system comprising a chain rotating in a closed loop comprising a load track and a return track interconnected by first and second turnaround sections;

a drive, which is arranged in the first turnaround section for driving the chain;

wherein the second turnaround section comprises a stationary turnaround structure which is configured to reverse the direction of travel of the chain by 180 degrees, the stationary turnaround structure extending at least partially along a polygon compensation curve, which is designed for compensating the polygon effect of the chain traveling along the loop providing a polygon compensation system; and wherein the method comprises rotating the drive sprocket with constant velocity.

19. A method of operating a conveyor system comprising a chain rotating in a closed loop comprising a load track and a return track interconnected by first and second turnaround sections;

a drive, which is arranged in the first turnaround section for driving the chain;

wherein the second turnaround section comprises a stationary turnaround structure which is configured to reverse the direction of travel of the chain by 180 degrees, the stationary turnaround structure extending at least partially along a polygon compensation curve, which is designed for compensating the polygon effect of the chain traveling along the loop providing a polygon compensation system;

wherein the method comprises rotating the drive sprocket with non-constant velocity in order to compensate for the polygon effect.

* * * * *